US005911639A

United States Patent [19]

Kasashima et al.

[11] Patent Number: 5,911,639

[45] Date of Patent: Jun. 15, 1999

[54] GOLF BALL

[75] Inventors: Atsuki Kasashima; Keisuke Ihara; Hirotaka Shimosaka; Kazuto Maehara; Michio Inoue, all of Chichibu, Japan

[73] Assignee: Bridgestone Sports Co., Ltd., Tokyo, Japan

[21] Appl. No.: 08/994,992

[22] Filed: Dec. 19, 1997

[30] Foreign Application Priority Data

Dec. 24, 1996 [JP] Japan ..... 8-355745

[51] Int. Cl.[6] ..... A63B 37/12; A63B 37/14

[52] U.S. Cl. ..... 473/377; 473/384

[58] Field of Search ..... 473/384, 383, 473/377, 372, 373, 378

[56] References Cited

U.S. PATENT DOCUMENTS

| | | | |
|---|---|---|---|
| 878,254 | 2/1908 | Taylor | 473/384 |
| 4,681,323 | 7/1987 | Alaki et al. | 273/232 |
| 4,979,747 | 12/1990 | Jonkouski | 473/384 X |
| 5,005,838 | 4/1991 | Oka | 473/384 |
| 5,470,076 | 11/1995 | Cadorniga | 473/384 |
| 5,601,503 | 2/1997 | Yamagishi et al. | 473/384 |
| 5,735,757 | 4/1998 | Moriyama | 473/384 |
| 5,779,563 | 7/1998 | Yamagishi et al. | 473/384 X |

*Primary Examiner*—George J. Marlo
*Attorney, Agent, or Firm*—Sughrue, Mion, Zinn, Macpeak & Seas, PLLC

[57] ABSTRACT

A two-piece solid golf ball comprising; a solid core formed of a rubber and a cover formed of an ionomer resin, the solid core has a diameter in the range of 35 to 41 mm and a hardness corresponding to distortion of 2.0 to 4.0 mm under applied load of 100 kg, the cover has a spherical surface, a Shore D hardness in the range of 40 to 70 and a gage in the range of 0.5 to 3 mm, and the spherical surface is formed of a plurality of dimples wherein, the dimples have a depth in the range of 0.08 to 0.15 mm and an average $V_O$ value for all the dimples is 0.5 to 0.9 where $V_O$ is the volume of a dimple space below a plane circumscribed by the dimple edge divided by the volume of a cylinder whose bottom is the plane and whose height is the maximum depth of the dimple from the bottom, and a percent dimple volume Vr given by the following equation is in the range of 0.75 to 1.15%:

$$Vr = \frac{Vs}{\frac{4}{3}\pi R^3} \times 100$$

where, Vs is in the sum of the volumes of dimples spaces each below a circular plane circumscribed by the dimple edge and R is the ball radius.

9 Claims, 5 Drawing Sheets

GOLF BALL

BACKGROUND OF THE INVENTION

1. Field of the Invention

This invention relates to a golf ball having improved flight performance and spin properties. More particularly, it relates to a golf ball having an optimum dimple depth and $V_0$ value so that the spin rate given upon full shots with a driver is optimized for added flight distance and the spin performance associated with approach shots with a sand wedge is improved.

2. Prior Art

A number of experiments and investigations have been made on golf balls for the purpose of improving the flight performance thereof. As a result of such prior experiments and investigations, it is now generally known that a ball of low spin structure using a relatively hard cover is advantageous for improving the flight performance upon full shots with a driver. Upon full shots with a driver which fall within an increased deformation region, a ball with a soft cover receives an increased spin rate so that the ball may sky, resulting in a rather reduced flight distance. On the other hand, if the spin rate is too low, there arises a problem that the ball on the descending course will prematurely drop, also adversely affecting the ultimate flight distance. As a consequence, an appropriate spin rate is still necessary upon driver shots. In contrast, the ball of low spin structure will roll too much upon approach shots with a sand wedge because the ball is less susceptible to spin. This leads to inconsistent ball control.

A number of investigations have also been made on the geometry (e.g., depth and diameter) and arrangement of dimples. Few golf balls meet both superior flight performance and spin performance.

There is a desire to have a golf ball that fully meets the contradictory demands of players, that is, the satisfactory flight performance where the ball acquires an adequate spin rate upon full shots with a driver and the ease of control where the ball acquires a high spin rate upon approach shots with a sand wedge.

SUMMARY OF THE INVENTION

Therefore, an object of the present invention is to provide a novel and improved golf ball which is improved in both flight and spin performances due to an optimum dimple configuration.

To achieve both the apparently contradictory purposes of improving flight performance and improving spin performance, inventors paid attention to the depth and cross-sectional shape of dimples formed on the ball surface. The inventors have found that a golf ball exerting superior flight and spin performance is obtained by properly selecting the dimple depth and an average value for all the dimples of $V_0$ which is the volume of a dimple space below a plane circumscribed by the dimple edge divided by the volume of a cylinder whose bottom is the plane and whose height is the maximum depth of the dimple from the bottom.

According to the investigations of the inventors, upon high head speed impact (increased deformation region) by full shots with a driver, a slight difference in dimple depth does not affect the flight performance and the spin rate depends solely on the ball structure. Upon low head speed impact (reduced deformation region) by approach shots with a sand wedge, dimples that are too deep lead to spin unsusceptibility because the club head does not come in full contact with the dimple bottom and the contact area between the ball surface and the club head is thus reduced. Inversely, shallow dimples lead to spin susceptibility because the contact area between the ball surface and the club head is increased. However, shallow dimples do not fully exert the dimple effect and thus allow the ball to fly aloft, failing to travel a satisfactory distance.

Based on these findings, we have found that the above objects are achieved by adjusting the dimple shape (cross-sectional shape) optimum to set the dimple depth in the range of 0.08 mm to 0.15 mm (to make the dimples as shallow as possible) and the average $V_0$ value in the range of 0.5 to 0.9 (to increase the $V_0$ value greater than conventional dimples). With these adjustments, the dimple volume is not substantially reduced. A sufficient contact area is insured between the ball surface and the club head even in the low head speed/less deformation region. Then upon approach shots with a sand wedge, the control of the ball is improved due to the increased spin rate. Upon full shots with a driver, the dimple effect is maintained, and the ball will follow an optimum trajectory and travel an outstandingly increased distance. The apparently contradictory demands of flight performance and spin performance improvements can be met in a harmonized manner independent of the ball structure and material.

JP-A 163674/1985 by the same assignee as the present invention discloses a golf ball having a plurality of dimples on its surface, characterized in that dimples having a $V_0$ value of 0.35 to 0.43 account for at least 90% of the entire dimples. The average $V_0$ range of 0.5 to 0.9 according to the present invention does not overlap the $V_0$ range of the previous proposal. The objects and advantages of the present invention including an increased flight distance upon driver shots and an increased spin rate upon iron shots are achievable only when both the dimple depth and the average $V_0$ value are optimized.

Accordingly, the present invention provides a golf ball having a plurality of dimples formed on its surface, characterized in that the dimples have a depth of 0.08 mm to 0.15 mm and an average $V_0$ value for all the dimples is 0.5 to 0.9. Preferably, dimples of non-circular plane shape account for at least 7% of the dimples.

DETAILED DESCRIPTION OF THE INVENTION

According to the invention, the dimples formed on the ball surface have a depth of 0.08 mm to 0.15 mm, preferably 0.09 mm to 0.13 mm. Dimples with a depth of less than 0.08 mm are too shallow to provide a substantial dimple depth and to exert the dimple effect. A dimple depth of more than 0.15 mm is substantially equal to a conventional one and not so effective for improving spin performance upon approach shots.

In addition to the requirement that the dimples be formed shallow as defined above, the golf ball of the invention requires that an average $V_0$ value for all the dimples be from 0.5 to 0.9, preferably from 0.53 to 0.8. It is assumed that $V_0$ is the volume of a dimple space below a plane circumscribed by the dimple edge divided by the volume of a cylinder whose bottom is the plane and whose height is the maximum depth of the dimple from the bottom. An average $V_0$ value of less than 0.5 leads to a too high trajectory whereas an average $V_0$ value in excess of 0.9 leads to a too low trajectory.

Figure 1:
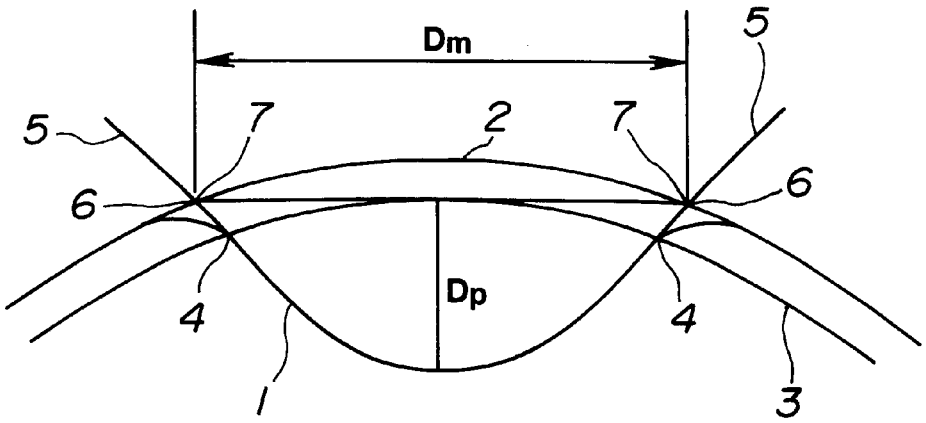
FIG. 1 is a schematic view (cross-sectional view) of a dimple illustrating how to calculate $V_0$.
Figure 2:
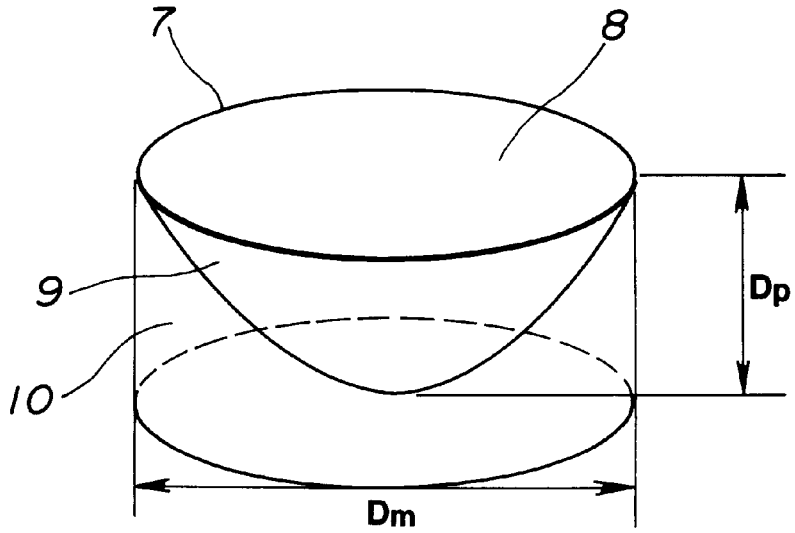
FIG. 2 is a perspective view of the same dimple.
Figure 3:
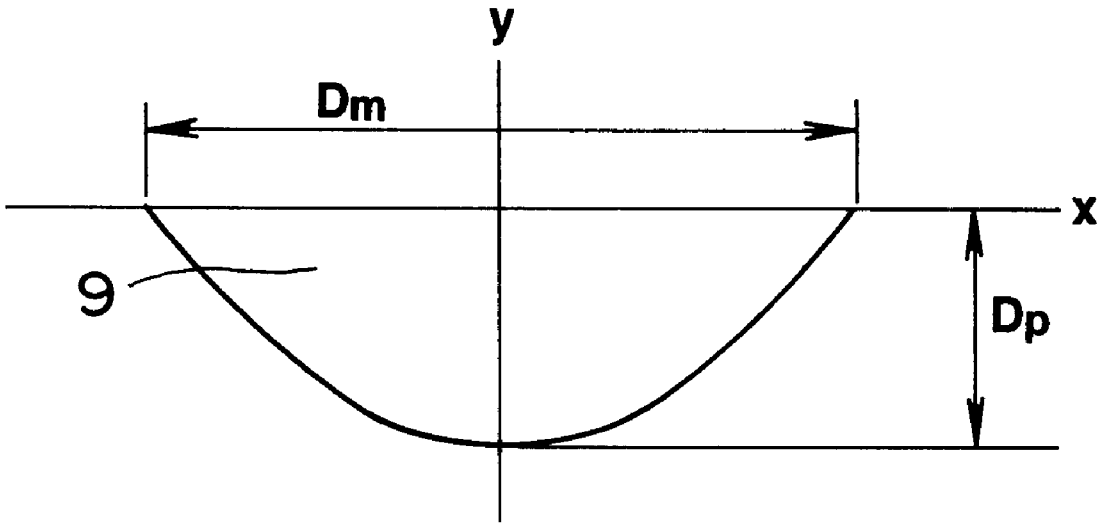
FIG. 3 is a cross-sectional view of the same dimple.

The $V_0$ value is described in further detail. Reference is first made to the event that the planar shape of a dimple is circular. In the cross section of FIG. 1 as viewed radially with respect to the ball center, a phantom sphere 2 having the ball diameter and another phantom sphere 3 having a diameter smaller by 0.16 mm than the ball diameter are drawn in conjunction with a dimple 1. The circumference of the other sphere 3 intersects with the dimple 1 at a point 4. A tangent 5 at intersection 4 intersects with the phantom sphere 2 at a point 6 while a series of intersections 6 define a dimple edge 7. The dimple edge 7 is so defined for the reason that otherwise, the exact position of the dimple edge cannot be determined because the actual edge of the dimple 1 is rounded. The dimple edge 7 circumscribes a plane 8 (a circle having a diameter Dm). Then as shown in FIGS. 2 and 3, the dimple space 9 located below the plane 8 has a volume Vp which is calculated according to equation (1). A cylinder 10 whose bottom is the plane 8 and whose height is the maximum depth Dp of the dimple from the bottom or circular plane 8 has a volume Vq which is calculated according to equation (2). The ratio $V_0$ of the dimple space volume Vp to the cylinder volume Vq is calculated ($V_0$= Vp/Vq). The $V_0$ values of all the dimples are averaged to give an average $V_0$ value.

$$Vp = \int_0^{\frac{Dm}{2}} 2\pi xy\, dx \tag{1}$$

$$Vq = \frac{\pi Dm^2 Dp}{4} \tag{2}$$

In the event that the planar shape of a dimple is not circular, the maximum diameter or length of a dimple is determined, the plane projected shape of the dimple is assumed to be a circle having a diameter equal to this maximum diameter or length, and $V_0$ is calculated as above based on this assumption. Where plural types, usually 2 to 5 types, especially 2 or 3 types of dimples are formed, $V_0$ is determined for each type of dimple and then averaged.

Figure 4:
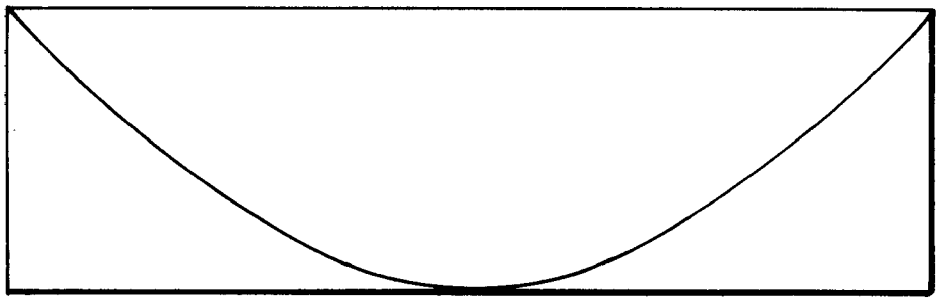
FIG. 4 is a schematic cross-sectional view of a prior art dimple.

When the dimple depth is made shallow as in the present invention, the overall dimple volume is reduced. According to the invention, the $V_0$ value is adjusted for optimizing the cross-sectional shape of dimples to compensate for the reduction of the overall dimple volume. More particularly, dimples on almost all conventional golf balls have a cross-sectional shape consisting of a portion of a sinusoidal curve as shown in FIG. 4 and having a $V_0$ value of 0.46. This cross-sectional shape forms a scoop in the spherical ball surface. Aerodynamically, this shape exerts a greater drag than lift. The initially imparted momentum is not fully utilized for flight distance. The aerodynamic properties are not fully utilized. Since the dimples are as deep as 0.24 mm, the control of the ball upon low head speed shots becomes difficult due to the reduced contact area between the ball surface and the club head and hence, the insufficiently increased spin rate.

Figure 5:
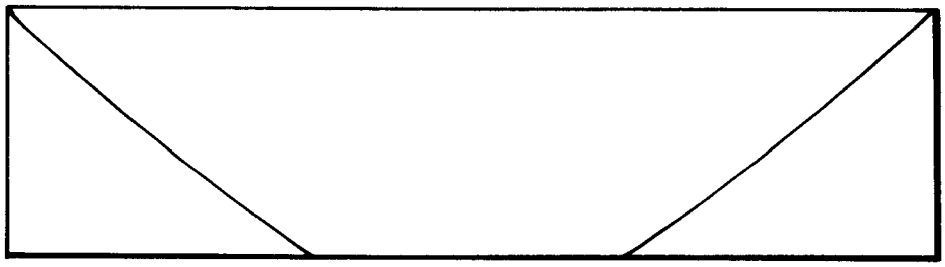
FIG. 5 is a schematic cross-sectional view of a dimple according to the invention.

In contrast, according to the invention, the cross-sectional shape of a dimple is not critical insofar as the dimple depth and the average $V_0$ value fall in the above-defined ranges. For example, the dimple is preferably formed to an approximate inverted trapezoid shape having a wide bottom as shown in FIG. 5. This shape enables an increase of the $V_0$ value such that a substantial dimple volume may be maintained. This maintains the dimple effect upon high head speed shots and at the same time, increases the ball surface-club head contact area and hence, the spin rate upon low head speed shots.

In the practice of the invention, a percent dimple volume Vr given by the following equation (3) is preferably in the range of 0.75% to 1.15%, especially 0.8% to 1.1%:

$$Vr = \frac{Vs}{\frac{4}{3}\pi R^3} \times 100 \tag{3}$$

wherein Vs is the sum of the volumes of dimple spaces each below a circular plane circumscribed by the dimple edge and R is a ball radius. Note that the spatial volume of one dimple is Vp as defined above.

The number of dimples is preferably 336 to 660, more preferably 362 to 500. There may be two or more types of dimples which are different in diameter and/or depth. Typically the dimples have a diameter of 1.8 to 5.0 mm, preferably 2.3 to 4.5 mm.

The shape of dimples is preferably circular in plane although the dimple shape is not critical. Non-circular dimples including ellipsoidal, oval, petaline, and polygonal planar shapes are acceptable. It is preferred for satisfying both flight performance and outer appearance that the proportion of non-circular dimples is at least 7%, more preferably 10 to 70%, most preferably 20 to 40% by number of the entire dimples. The dimple arrangement may be any conventional arrangement.

In the golf ball of the invention wherein dimples are formed on the ball surface to satisfy the above-mentioned requirements, the spin performance at low head speeds is improved at no sacrifice of the flight performance at high head speeds.

While the golf ball of the invention must have an optimum dimple depth and an optimum average $V_0$ value, the structure and material of the ball are not critical. The present invention is applicable to any type of golf ball including solid golf balls such as one-piece golf balls, two-piece golf balls, and multi-piece golf balls of three or more layer structure and wound golf balls. Better results are obtained when the invention is applied to two-piece solid golf balls comprising a solid core enclosed with a cover.

The two-piece solid golf ball to which the invention is advantageously applicable is briefly described. The solid core may be formed of a rubber composition comprising a base rubber commonly used in the core of conventional solid golf balls and such components as a co-crosslinking agent and peroxide. The base rubber may be polybutadiene rubber, polyisoprene rubber or a mixture thereof. It is preferred for high resilience to use 1,4-polybutadiene rubber having at least 90% of cis structure. The core should preferably have a hardness corresponding to a distortion of 2.0 to 4.0, more preferably 2.5 to 3.5 mm under an applied load of 100 kg, a diameter of 35 to 41 mm, more preferably 37.0 to 39.7 mm, and a weight of 24 to 37 g, more preferably 25 to 36 g.

The cover surrounding the core may be formed of any of thermoplastic resins such as ionomer resins commonly used as a cover stock in conventional golf balls. The cover should preferably have a Shore D hardness of 40 to 70, more preferably 50 to 65 and a gage of 0.5 to 3 mm, more preferably 0.7 to 2.5 mm.

The two-piece golf ball may be conventionally prepared, for example, by injection molding a cover stock around a core or by preforming a pair of half cups from a cover stock and heat compression molding the half cups to a core. The two-piece golf ball thus obtained should preferably have a hardness corresponding to a distortion of 2.0 to 4.0 mm, more preferably 2.2 to 3.8 mm under an applied load of 100 kg. The diameter and weight of the ball are properly determined in accordance with the Rules of Golf.

There has been described a golf ball in which the dimple configuration is optimized such that the flight distance upon full shots with a driver may be increased and the spin performance upon approach shots with a sand wedge may be improved independent of the ball structure and material.

EXAMPLE

Examples of the invention are given below by way of illustration and not by way of limitation.

Examples 1–4 and Comparative Examples 1–2

Solid cores having physical properties as shown in Table 1 were prepared by mixing core components as shown in Table 1 and molding and vulcanizing the core compositions in a mold at 155° C. for about 20 minutes.

Two-piece solid golf balls were prepared by mixing cover components as shown in Table 1 and injection molding the cover compositions around the solid cores. The balls had physical properties as shown in Table 1.

TABLE 1

| | | Example | | | | Comparative Example | |
|---|---|---|---|---|---|---|---|
| | | 1 | 2 | 3 | 4 | 1 | 2 |
| Core composition (pbw) | Butadiene rubber* | 100 | 100 | 100 | 100 | 100 | 100 |
| | Zinc diacrylate | 27 | 27 | 27 | 27 | 27 | 27 |
| | Zinc oxide | 5 | 5 | 5 | 5 | 5 | 5 |
| | Barium sulfate | 18 | 18 | 18 | 18 | 18 | 18 |
| | Dicumyl peroxide | 1 | 1 | 1 | 1 | 1 | 1 |
| Cover composition (pbw) | Himilan 1557 | 60 | 60 | 60 | 60 | 60 | 60 |
| | Surlyn 8120 | 40 | 40 | 40 | 40 | 40 | 40 |
| Core | Diameter (mm) | 38.6 | 38.6 | 38.6 | 38.6 | 38.6 | 38.6 |
| | Hardness** (mm) | 2.8 | 2.8 | 2.8 | 2.8 | 2.8 | 2.8 |
| Cover | Gage (mm) | 2 | 2 | 2 | 2 | 2 | 2 |
| | Shore D hardness | 53 | 53 | 53 | 53 | 53 | 53 |
| Ball | Hardness** (mm) | 2.6 | 2.6 | 2.6 | 2.6 | 2.6 | 2.6 |
| | Weight (g) | 45.3 | 45.3 | 45.3 | 45.3 | 45.3 | 45.3 |
| | Diameter (mm) | 42.67 | 42.67 | 42.67 | 42.67 | 42.67 | 42.67 |

Figure 6:
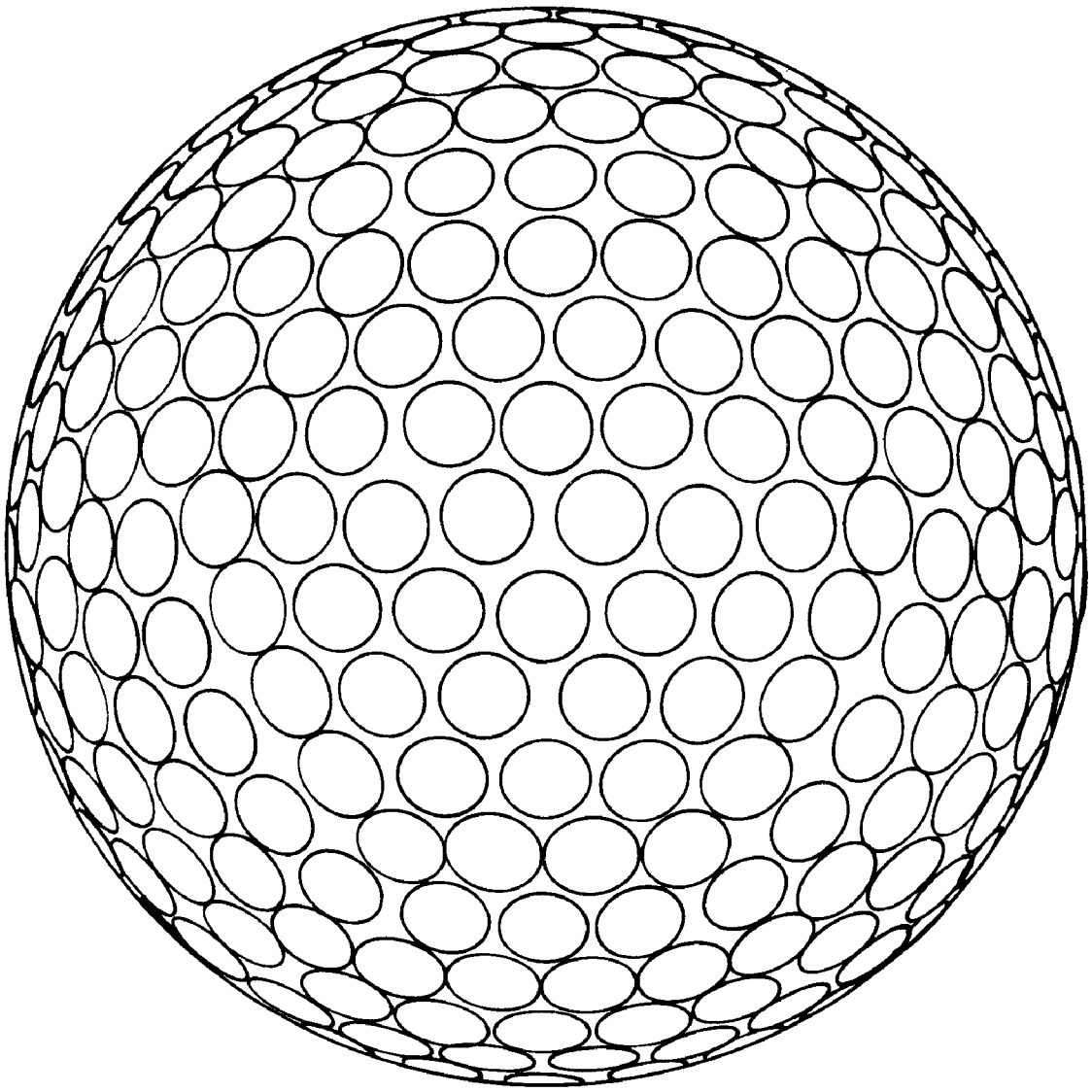
FIG. 6 illustrates a dimple arrangement pattern on a golf ball according to the invention as viewed in a pole direction.
Figure 7:
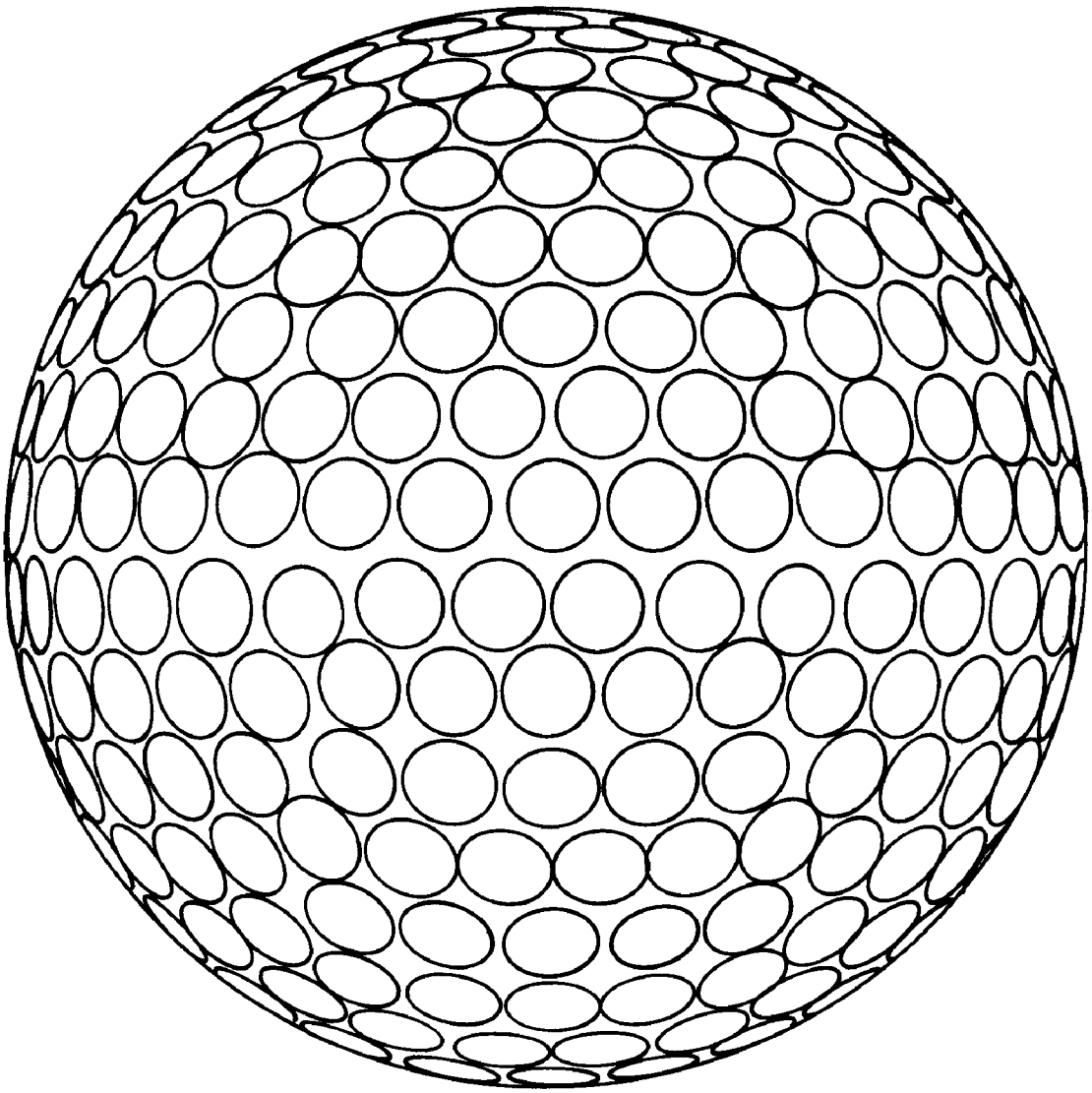
FIG. 7 illustrates the dimple arrangement pattern on a golf ball as viewed in a seam direction.

*High-cis poly-1,4-butadiene rubber, BR01 by Japan Synthetic Rubber K.K.
a distortion (mm) under an applied load of 100 kg The golf balls had dimples on their surface with dimple parameters shown in Tables 2 and 3. The $V_0$ and Vr values associated with the dimples were calculated. The results are also shown in Tables 2 and 3. The dimple arrangement pattern on these golf balls is shown in FIG. 6 as viewed in a pole direction and in FIG. 7** as viewed in a seam direction.

Using a swing robot of True Temper Co., the golf balls were measured for carry, total, and spin by hitting them with a driver (#W1, "J's Metal 7.5" by Bridgestone Sports Co., Ltd.) at a head speed of 45 m/sec. The golf balls were also measured for spin by hitting them with a sand wedge (#SW, "Jumbo MTN3 Professional Model," loft angle 57°, by Bridgestone Sports Co., Ltd.) at a head speed of 20 m/sec. The results are also shown in Tables 2 and 3.

TABLE 2

| | Example | | | |
|---|---|---|---|---|
| | 1 | 2 | 3 | 4 |
| Ball diameter (mm) | 42.67 | 42.67 | 42.67 | 42.67 |
| Ball overall volume ($mm^3$) | 40677.45 | 40677.45 | 40677.45 | 40677.45 |
| Dimple number | 396 | 396 | 396 | 396 |
| Dimple diameter (mm) | 3.7 | 3.7 | 3.7 | 3.7 |
| Dimple depth (mm) | 0.089 | 0.105 | 0.125 | 0.149 |
| Dimple overall volume ($mm^3$) | 341.0423 | 344.2356 | 345.9386 | 342.5751 |

TABLE 2-continued

| | | Example | | | |
|---|---|---|---|---|---|
| | | 1 | 2 | 3 | 4 |
| Average $V_0$ | | 0.89 | 0.76 | 0.63 | 0.54 |
| Vr (%) | | 0.84 | 0.85 | 0.85 | 0.84 |
| #W1/HS45 | Carry (m) | 210 | 211 | 213 | 212 |
| | Total (m) | 226 | 226 | 229 | 229 |
| | Spin (rpm) | 2552 | 2570 | 2525 | 2490 |
| #SW/HS20 | Spin (rpm) | 5240 | 4980 | 4520 | 4310 |

TABLE 3

| | | Comparative Example | |
|---|---|---|---|
| | | 1 | 2 |
| Ball diameter (mm) | | 42.67 | 42.67 |
| Ball overall volume ($mm^3$) | | 40677.45 | 40677.45 |
| Dimple number | | 396 | 396 |
| Dimple diameter (mm) | | 3.7 | 3.7 |
| Dimple depth (mm) | | 0.164 | 0.168 |
| Dimple overall volume ($mm^3$) | | 342.1493 | 343.3414 |
| Average $V_0$ | | 0.49 | 0.48 |
| Vr (%) | | 0.84 | 0.84 |
| #W1/HS45 | Carry (m) | 209 | 210 |
| | Total (m) | 225 | 225 |
| | Spin (rpm) | 2495 | 2505 |
| #SW/HS20 | Spin (rpm) | 3950 | 3940 |

As is evident from Tables 2 and 3, the golf balls of the invention receive an appropriate spin rate and travel a long distance upon full shots with a driver while they receive an increased spin rate upon approach shots with a sand wedge.

Although some preferred embodiments have been described, many modifications and variations may be made thereto in the light of the above teachings. It is therefore to be understood that within the scope of the appended claims, the invention may be practiced otherwise than as specifically described.

We claim:

1. A two-piece solid golf ball comprising; a solid core formed of a rubber and a cover formed of an ionomer resin, said solid core having a diameter in the range of 35 to 41 mm and a hardness corresponding to distortion of 2.0 to 4.0 mm under an applied load of 100 kg, said cover having a spherical surface, a Shore D hardness in the range of 40 to 70 and a gage in the range of 0.5 to 3 mm, and said spherical surface being formed of a plurality of dimples wherein, said dimples have a depth in the range of 0.08 to 0.15 mm and an average $V_0$ value for all the dimples is 0.5 to 0.9, where, $V_0$ is the volume of a dimple space below a plane circumscribed by the dimple edge divided by the volume of a cylinder whose bottom is the plane and whose height is the maximum depth of the dimple from the bottom, and a percent dimple volume Vr given by the following equation is in the range of 0.75 to 1.15%:

$$Vr = \frac{Vs}{\frac{4}{3}\pi R^3} \times 100$$

where, Vs is in the sum of the volumes of dimple spaces each below a circular plane circumscribed by the dimple edge and R is the ball radius.

2. The two-piece golf ball of claim 1, wherein the number of said dimples is 336 to 660.

3. The two-piece golf ball of claim 2, wherein said dimples are composed of two or more different types determined by different diameter and/or depth, said diameter being in the range of 1.8 to 5.0 mm.

4. The two-piece golf ball of claim 1, wherein dimples having a non-circular plane shape account for at least 7% of the dimples.

5. The two-piece golf ball of claim 1, wherein said dimples have a depth in the range of 0.09 to -to 0.13 mm.

6. The two-piece golf ball of claim 1, wherein $V_0$ is in the range of 0.53 to 0.80.

7. The two-piece golf ball of claim 1, wherein $V_r$ is in the range of 0.8% to 1.1%.

8. The two-piece golf ball of claim 1, wherein said dimples have a diameter in the range of 2.3 to 4.5 mm.

9. The two-piece golf ball of claim 1, wherein dimples having a non-circular shape account for 10 to 70% of the total number of dimples.

* * * * *